US009739029B2

(12) United States Patent
Scurria et al.

(10) Patent No.: US 9,739,029 B2
(45) Date of Patent: Aug. 22, 2017

(54) DISPOSABLE FORMWORK FOR MAKING VENTILATED LOOSE STONE FOUNDATION AND A VENTILATED LOOSE STONE FOUNDATION COMPRISING SAID FORMWORK

(71) Applicant: SICILFERRO TORRENOVESE S.R.L., Torrenova (IT)

(72) Inventors: Alessandro Calogero Scurria, Sant'Agata di Militello (IT); Rosario Scurria, Sant'Agata di Militello (IT)

(73) Assignee: SICILFERRO TORRENOVESE S.R.L., Torrenova (IT)

( * ) Notice: Subject to any disclaimer, the term of this patent is extended or adjusted under 35 U.S.C. 154(b) by 0 days.

(21) Appl. No.: 14/777,947

(22) PCT Filed: Apr. 10, 2014

(86) PCT No.: PCT/IB2014/060610
§ 371 (c)(1),
(2) Date: Sep. 17, 2015

(87) PCT Pub. No.: WO2014/167521
PCT Pub. Date: Oct. 16, 2014

(65) Prior Publication Data

US 2016/0222621 A1 Aug. 4, 2016

(30) Foreign Application Priority Data

Apr. 12, 2013 (IT) ..... MI2013A0607

(51) Int. Cl.
*E02D 31/00* (2006.01)

(52) U.S. Cl.
CPC .... *E02D 31/008* (2013.01); *E02D 2250/0023* (2013.01)

(58) Field of Classification Search
USPC ..... 405/299
See application file for complete search history.

(56) References Cited

U.S. PATENT DOCUMENTS 2,101,019 A * 12/1937 Bowes ..... E04B 5/32 249/175
2,792,164 A * 5/1957 Cauffiel ..... A47B 96/205 181/293

(Continued)

FOREIGN PATENT DOCUMENTS

EP 1614823 A2 1/2006
WO 9621931 A1 7/1996

OTHER PUBLICATIONS

PCT International Search Report issued for PCT/IB2014/060610 filed on Apr. 10, 2014 in the name of Sicilferro Torrenovese S.R.L. mail date: Aug. 5, 2015.

(Continued)

*Primary Examiner* — Kyle Armstrong
(74) *Attorney, Agent, or Firm* — Steinfl + Bruno LLP

(57) ABSTRACT

A disposable formwork for making ventilated loose stone foundations, in particular for floors, slabs, storage and/or collection tanks, dispersion tanks, alveolar concrete beds, cavities and/or similar building structures is described. The disposable formwork comprises a body having a first substantially convex surface intended to receive at least one binding material casting, optionally concrete, and a second surface, facing the opposite side of the first surface, substantially concave and suitable for delimiting, at least partly, a cavity; at least one support element, in particular four, having at least one contact portion arranged to engage a bottom surface of a cavity of a building structure under construction and arranged to support the body according to a position spaced from the bottom surface of the cavity. The disposable formwork has at least one portion made of (Continued)

polystyrene. Preferably, the entire structure of the disposable formwork is advantageously made of polystyrene.

12 Claims, 10 Drawing Sheets

(56) References Cited

U.S. PATENT DOCUMENTS

| | | | | |
|---|---|---|---|---|
| 5,540,524 | A * | 7/1996 | Gonsalves | E04B 5/21 405/257 |
| 5,934,036 | A * | 8/1999 | Gallagher, Jr. | E04B 5/36 249/188 |
| 6,550,207 | B1 * | 4/2003 | Pontarolo | E04B 5/48 52/437 |
| 7,540,121 | B2 * | 6/2009 | Haeussler | E04C 5/0645 52/323 |
| 2003/0115809 | A1 * | 6/2003 | Pontarolo | E04B 5/48 52/80.1 |
| 2006/0239782 | A1 * | 10/2006 | Hunt | E04G 13/00 405/230 |
| 2009/0145072 | A1 * | 6/2009 | Li | E02D 29/025 52/652.1 |
| 2010/0146899 | A1 * | 6/2010 | Zante | F24J 2/5205 52/584.1 |
| 2013/0283714 | A1 * | 10/2013 | Caboni | E02D 27/34 52/341 |

OTHER PUBLICATIONS

PCT Written Opinion issued for PCT/IB2014/060610 filed on Apr. 10, 2014 in the name of Sicilferro Torrenovese S.R.L. mail date: Aug. 5, 2015.

* cited by examiner

DISPOSABLE FORMWORK FOR MAKING VENTILATED LOOSE STONE FOUNDATION AND A VENTILATED LOOSE STONE FOUNDATION COMPRISING SAID FORMWORK

CROSS REFERENCE TO RELATED APPLICATIONS

The present application is the US national stage of International Patent Application PCT/IB2014/060610 filed internationally on Apr. 10, 2014 which, in turn, claims priority to Italian Patent Application No. MI2013A000607 filed on Apr. 12, 2013.

The present invention refers to a disposable formwork for making ventilated loose stone (i.e. rubble) foundations, in particular for floors, slabs, storage and/or collection tanks, dispersion tanks, alveolar concrete beds, cavities and/or similar building structures.

Another object of the present invention is a ventilated loose stone foundation, in particular for floors, slabs, storage and/or collection tanks, dispersion tanks, alveolar concrete beds, cavities and/or similar building structures, comprising such a disposable formwork.

The object of the present invention is suitable for being used in the field of construction and, in particular, it is intended for making floors, slabs, storage and/or collection tanks, dispersion tanks, alveolar concrete beds, cavities and/or similar, of building structures under construction.

As it is known, during the construction of building structures for residential use like for example houses, apartment houses, apartment buildings, buildings and/or the like, or for non-residential use, like for example warehouses, factories and/or any other infrastructure, a series of air chambers, called in the field loose stone foundations, are generally made at the foundations. The loose stone foundations are suitably arranged in fluid communication with one another and/or with the outside so as to ensure a satisfactory level of aeration and ventilation. The presence of ventilated loose stone foundation produces a series of advantages ranging from the insulation of the building structure with respect to the rising damp and to the draining of the radioactive gas Radon, coming from the ground.

The aforementioned ventilated loose stone foundations are currently made by means of suitable disposable or modular formworks of polypropylene which, when laid and hooked to one another, define a horizontal plane below which a ventilated cavity is delimited.

Disposable formworks for making ventilated floors generally comprise a body, which is mainly dome-shaped or arched dome shaped, from which four support elements extend the ends of which are suitable for engaging the bottom surface of the cavity of the building structure under construction.

Among the various disposable formworks for making ventilated floors which are available on the market, there are formworks the support elements of which are integral with the body, so as to form a single piece structure, and modular formworks the body of which can be associated with and hooked to support elements having different dimensions according to the contingent requirements.

Although the known disposable formworks described above allow making suitable ventilation cavities, the Applicant found that these still have, however, some drawbacks and they can be improved in different aspects, mainly relating to heat insulation of the building structures above them, to the lightness of such formworks, to the production and commercialisation costs thereof, to the capability of these to adapt to different depths and lateral dimensions of the cavities of the building structures under construction, as well as to the overall bulk thereof both during transportation and relating to storing.

In particular, the Applicant found that the materials used for making the aforementioned disposable formworks, such as for example polypropylene and/or similar plastic materials, greatly affect both the masses and the overall production and commercialisation costs thereof.

In addition, the aforementioned types of known formworks require the availability of numerous and wide storage spaces, as well as of considerable transportation volumes due to the fact that the adaptability of the loose stone foundations at the different cavities of the building structures to be made exclusively depends on the accessibility and on the availability of the various pieces having different sizes and dimensions. In other words, the requirement of having significant storage and/or transportation volumes available depends on the need of having sufficient stock of formworks having different dimensions and sizes.

Such a need is particularly important both in relation to the type of single piece formworks and in relation to the type of modular formworks. Indeed, as far as single piece formworks are concerned, it is necessary to have a large amount of pieces available having overall different dimensions and sizes. On the contrary, as far as modular formworks are concerned, it is necessary to have sufficient supply of support elements having different sizes to be used and possibly replaced in relation to the different types of ventilation cavities to be defined inside the cavities of the building structures under construction.

The main purpose of the present invention is to provide a disposable formwork for making ventilated loose stone foundations, in particular for floors, slabs, storage and/or collection tanks, dispersion tanks, alveolar concrete beds, cavities and/or similar building structures and a ventilated loose stone foundation provided with such formworks, that is capable of solving the drawbacks found in the prior art.

A further purpose of the present invention is to provide a disposable formwork for making ventilated loose stone foundations that is capable of heat insulating the building structures above it.

Another purpose of the present invention is to provide a formwork for making ventilated loose stone foundations having overall small masses.

Another purpose of the present invention is to propose a formwork for making ventilated loose stone foundations that can be made and commercialised with low costs.

A further purpose of the present invention is to provide a disposable formwork for making ventilated loose stone foundations that is adjustable both in height and in width.

A further purpose of the present invention is to provide a disposable formwork for making ventilated loose stone foundations that is capable of greatly reducing the transportation and storing volumes thereof.

The purposes specified above, and yet others, are substantially achieved with a disposable formwork for making ventilated loose stone foundations, in particular for floors, slabs, storage and/or collection tanks, dispersion tanks, alveolar concrete beds, cavities and/or similar building structures and a ventilated loose stone foundation that is provided with such disposable formwork, as outlined and described in the following claims.

It is now provided, as an example, the description of a preferred, but not exclusive, embodiment of a disposable formwork for making ventilated loose stone foundations, in particular for floors, slabs, storage and/or collection tanks, dispersion tanks, alveolar concrete beds, cavities and/or similar building structures, and a ventilated loose stone foundation that is provided with such a disposable formwork, in accordance with the present invention. Such a description shall be made in the rest of the description with reference to the attached drawings, which are provided only as an indication and therefore not for limiting purposes, in which:

With reference to the attached figures, reference 1 wholly indicates a disposable formwork for making ventilated loose stone foundations 2, in particular for floors, slabs, storage and/or collection tanks, dispersion tanks, alveolar concrete beds, cavities and/or similar building structures, in accordance with the present invention.

Figure 8:
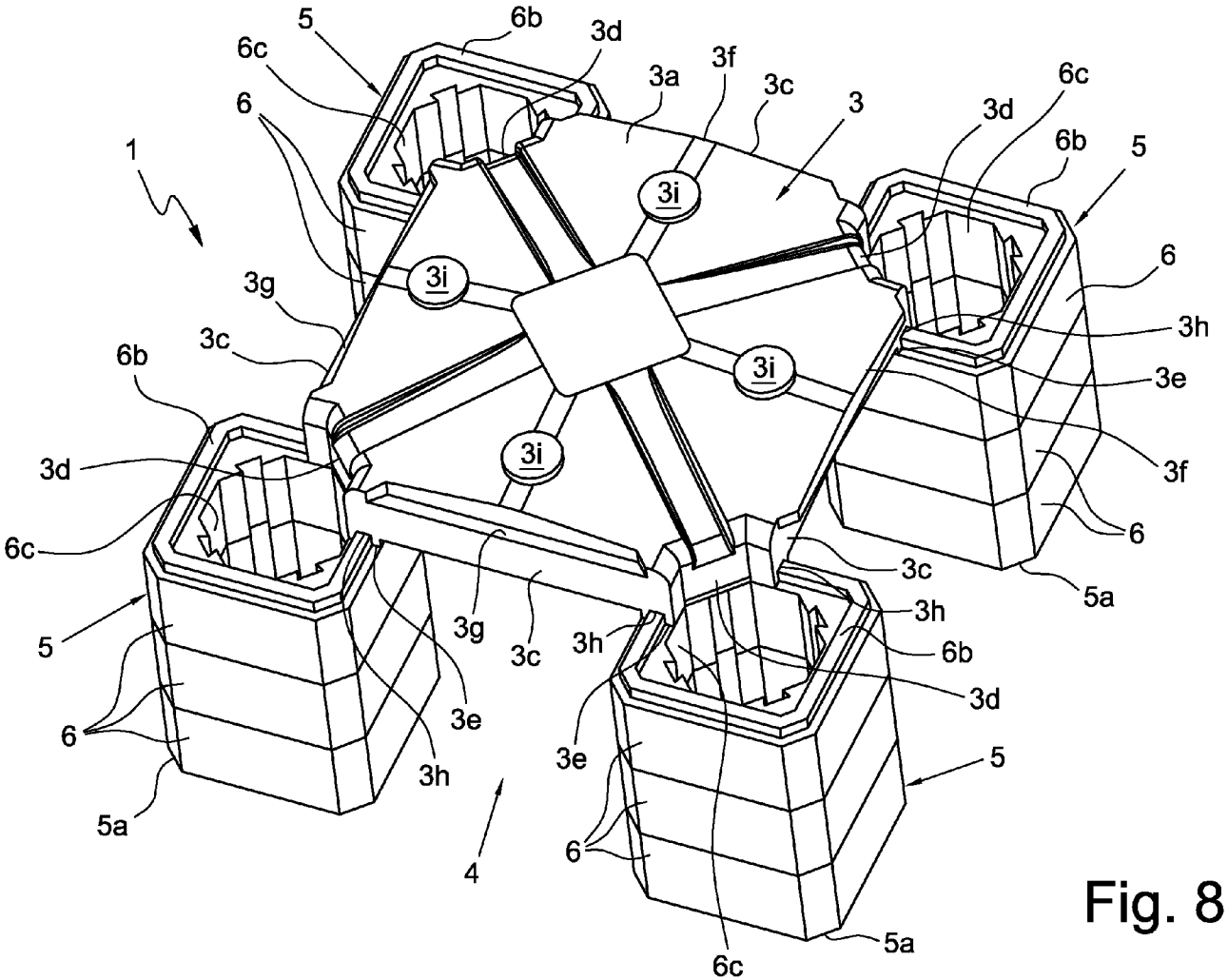
FIG. 8 is an upper perspective view of a disposable formwork for making ventilated loose stone foundations, in accordance with a second embodiment.
Figure 9:
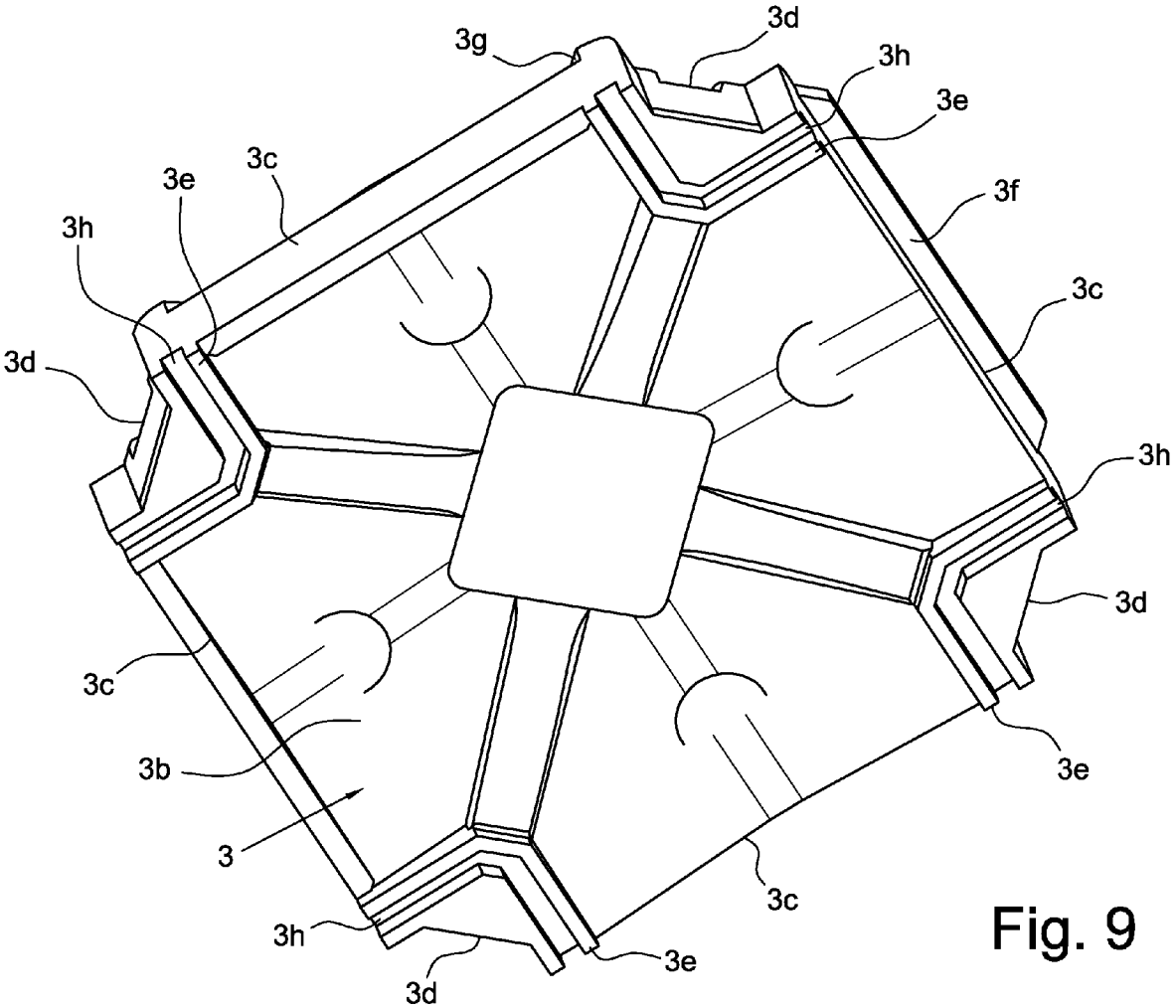
FIG. 9 is a lower perspective view of a detail of the disposable formwork according to FIG. 7.
Figure 10:
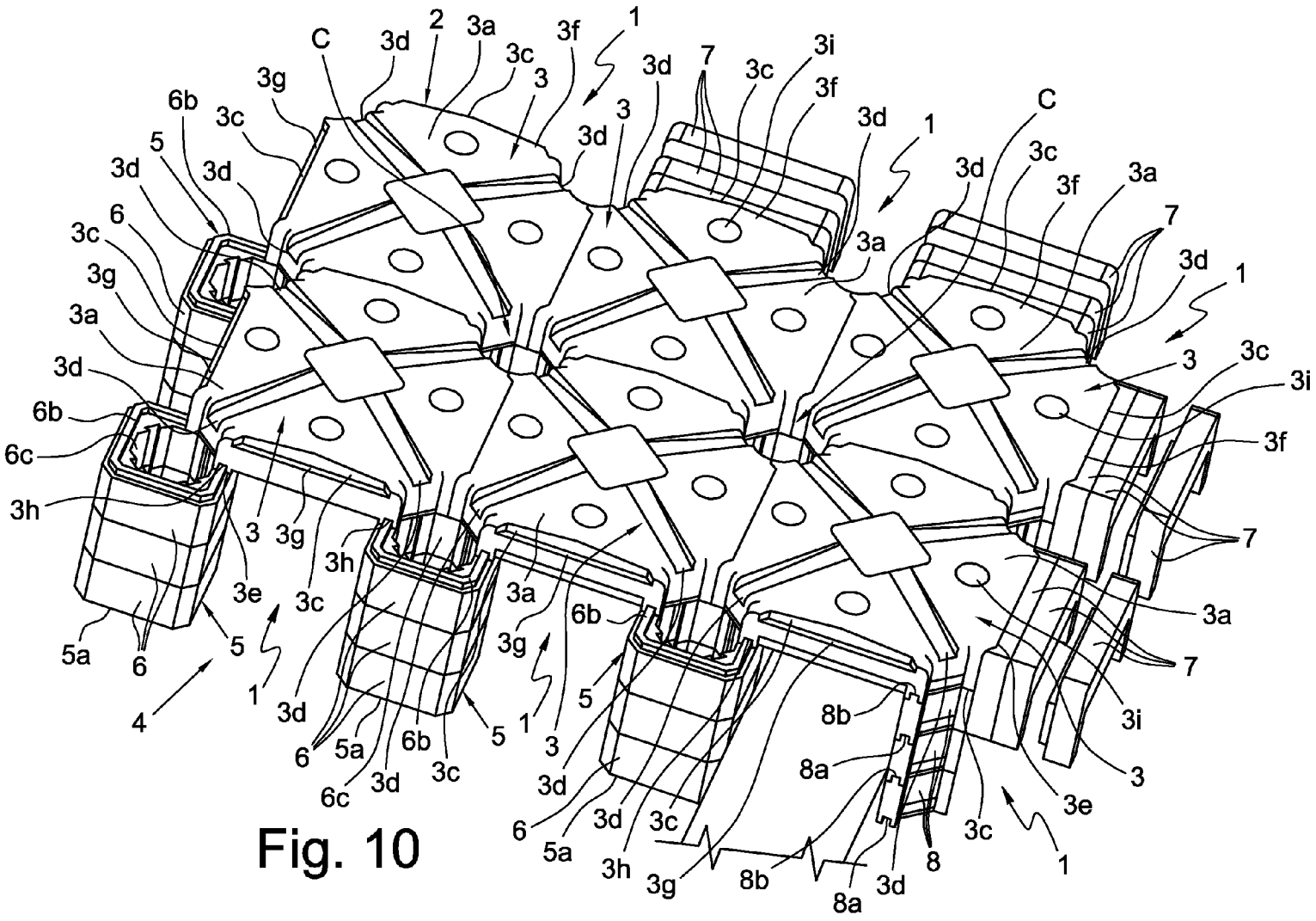
FIG. 10 is an upper perspective view of a first example of ventilated loose stone foundation made of a plurality of disposable formworks according to FIGS. 7 and 8.
Figure 12:
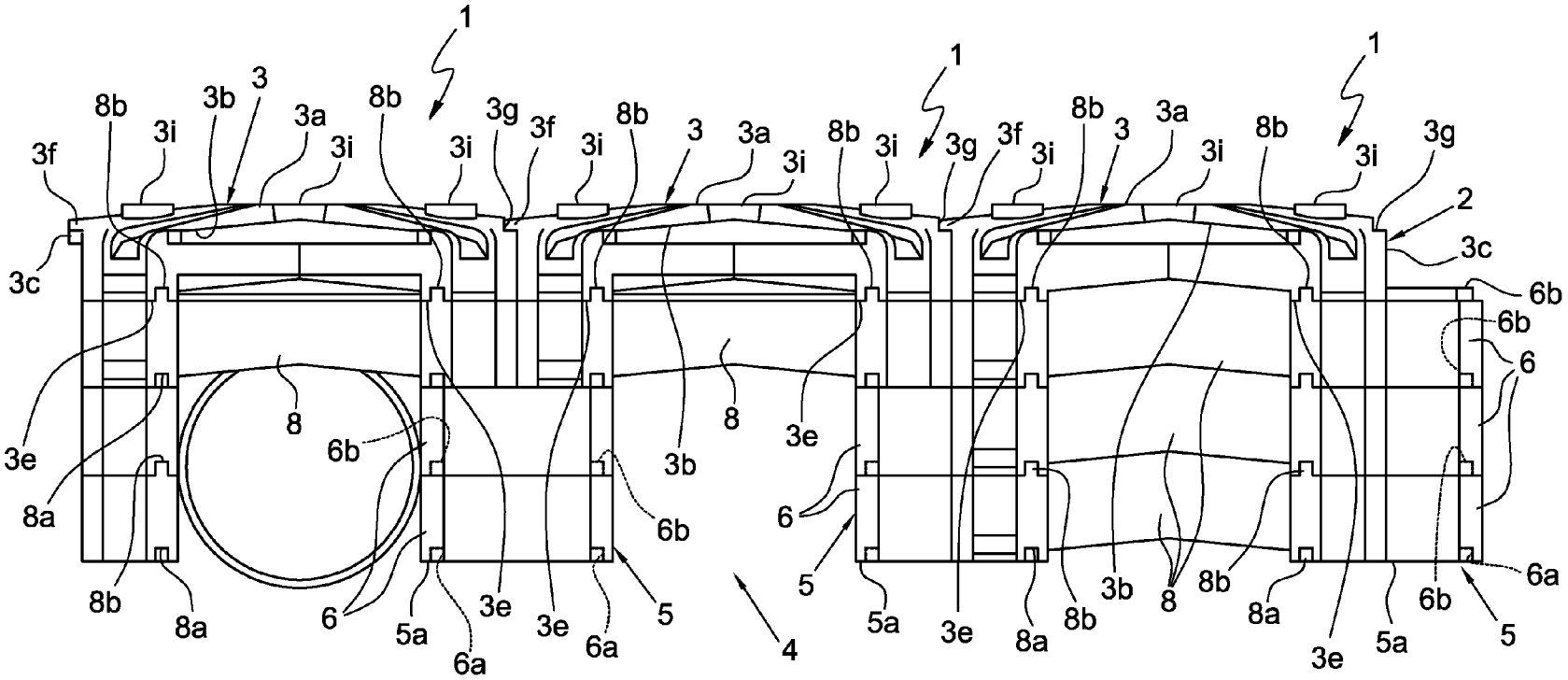
FIG. 12 is a schematic section view of the ventilated loose stone foundation according to FIG. 11 made along the line XII-XII.

The disposable formwork 1 comprises a body 3 having a first substantially convex surface 3*a* that is intended to receive at least one binding material casting, optionally concrete, and a second surface 3*b*, facing the opposite side of the first surface 3*a*, that is substantially concave and suitable for delimiting, at least partly, a cavity 4 (visible in FIGS. 8, 10 and 12).

As visible in figures from 1 to 4 from 5 to 12 and 15 the body 3 of the formwork 1 has a shape that is substantially quadrangular, optionally squared, in which it is possible to identify four sides 3*c*, in opposite pairs, and four corners 3*d*, each interposed between adjacent pairs of sides 3*c*.

Advantageously, the first surface 3*a* of the body 3 has, at each corner 3*d* of the latter, a concavity that is suitable for defining a portion for conveying the binding material used for casting. In other words, each corner 3*d* of the body 3 of the formwork 1 has a depression such as to convey the casting of binding material in correspondence to the corner itself.

Preferably, the body 3 of the formwork 1 further has, at each corner 3*d*, at least one lower resting portion 3*e* that is suitable for directly engaging a bottom surface of a cavity of a building structure (not illustrated since it is known) to be made or a respective accessory that can be interposed between the body 3 and such a bottom surface.

According to a further advantageous aspect of the present invention, two sides 3*c* of the body 3, preferably adjacent to one another, are provided with two engagement projections 3*f*, whereas the other two sides 3*c* that are adjacent with respect to one another and are opposite the sides 3*c* provided with engagement projections 3*f*, are equipped with corresponding engagement seats 3*g*. The engagement projections 3*f* are preferably counter-shaped with respect to the engagement seats 3*g* so as to allow a side fit-coupling between groups of disposable formworks 1, optionally identical, the joining of which allows making corresponding ventilated loose stone foundations 2 (FIGS. 7, 10, 11 and 15). The ventilated loose stone foundations 2 defined by the joining of the aforementioned disposable formworks 1 are advantageously configured substantially in a matrix configuration so as to define, at the corners 3*d* respectively facing the bodies 3 of the disposable formworks 1, corresponding containment channels C (FIGS. 7, 10, 11 and 15) for conveying the casting of binding material.

Figure 1:
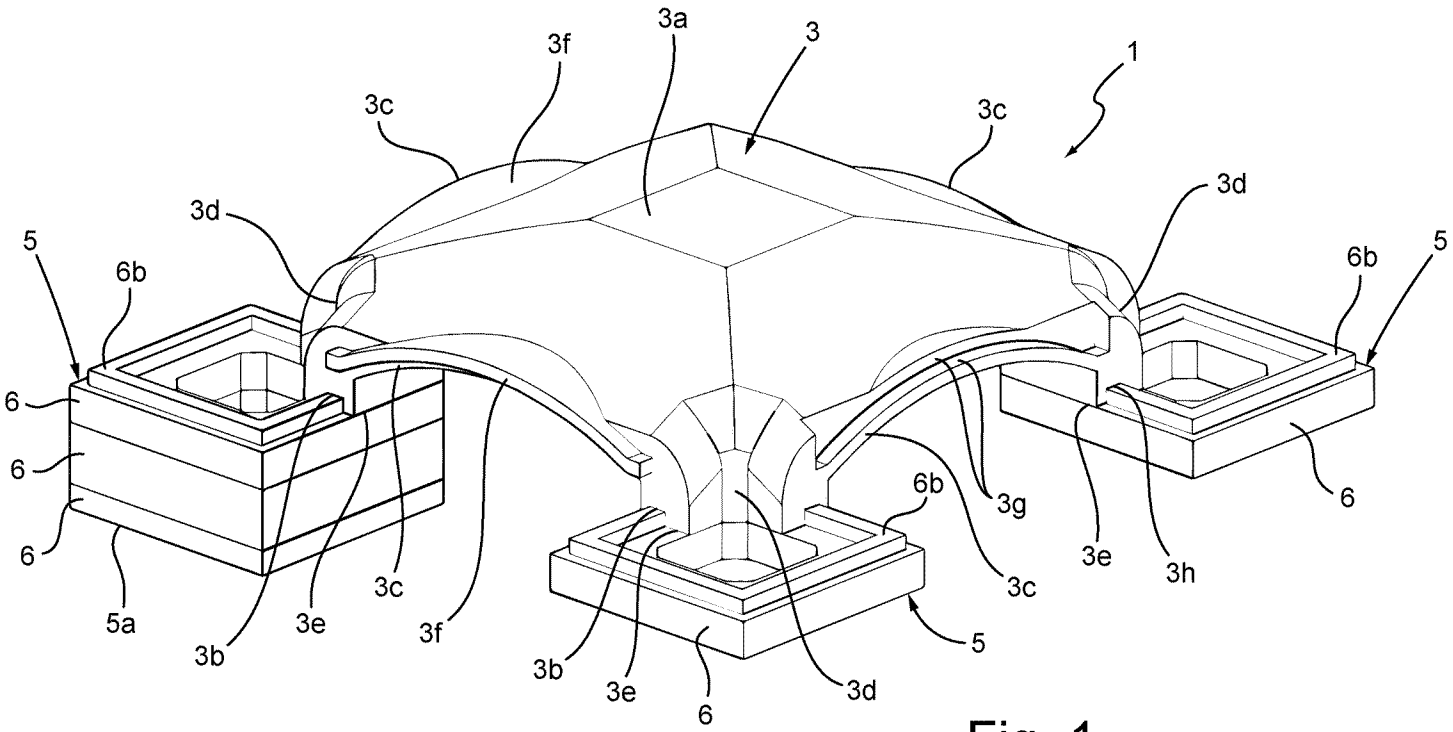
FIG. 1 is an upper perspective view of a disposable formwork for ventilated loose stone foundations, in accordance with a first embodiment solution of the present invention.
Figure 7:
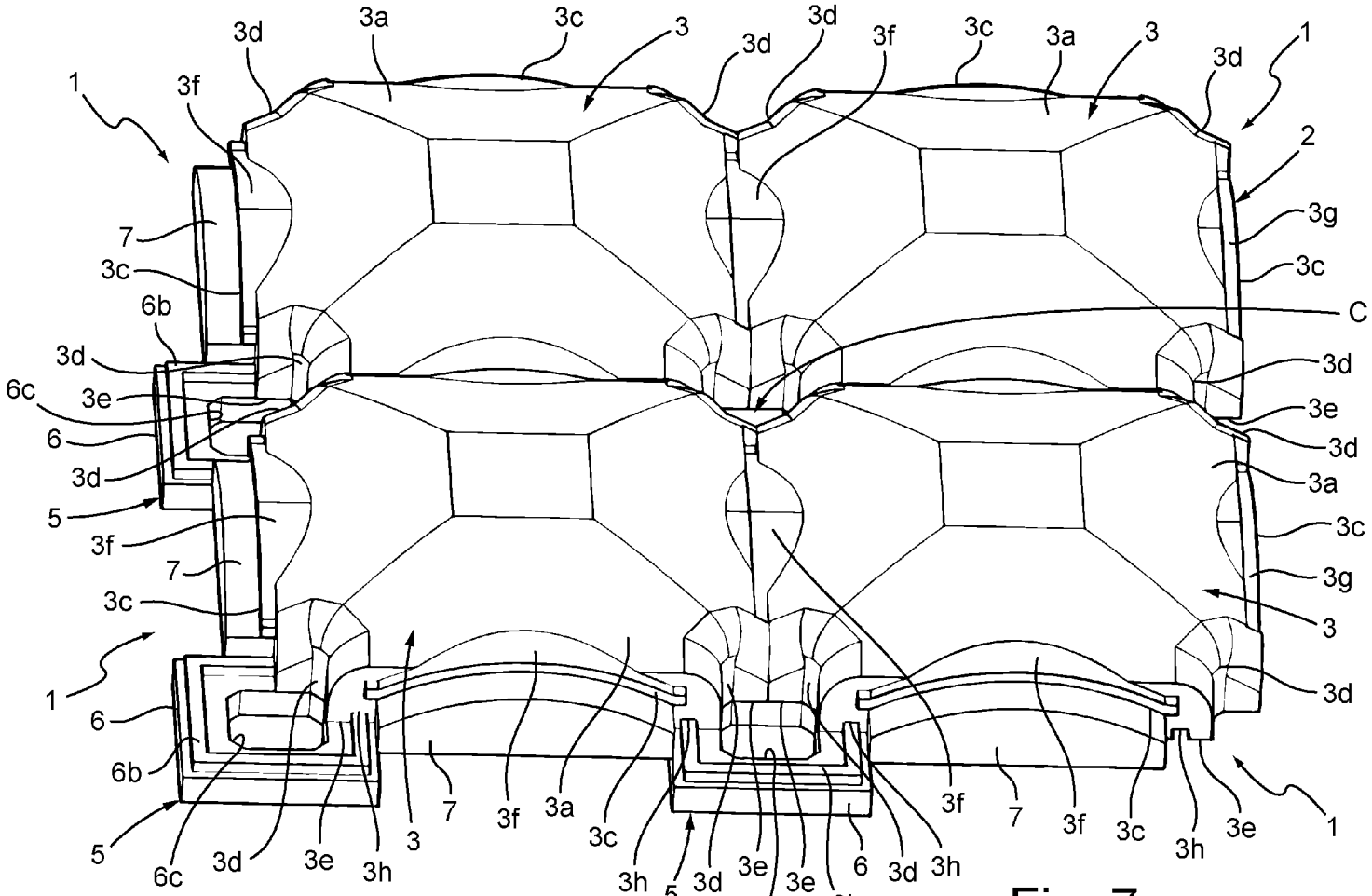
FIG. 7 is an upper perspective view of a ventilated loose stone foundation made of a plurality of disposable formworks according to the previous figures.

As represented in FIGS. 1, 7, 8, from 10 to 12 and 15, each disposable formwork 1 comprises at least one support element 5, in particular four, each of which has at least one contact portion 5*a* that is arranged to engage a bottom surface of a cavity 11 (FIG. 15) of a building structure under construction (not shown) or a respective accessory (not illustrated) that can be interposed between the bottom surface of such a cavity and the support element itself.

Advantageously, the support elements 5 are suitable for supporting the body 3 of the respective disposable formwork 1 according to a position spaced from the bottom surface of the cavity 15 of the building structure to be made. Thanks to the support elements 5, each disposable formwork 1 is advantageously adjustable in height in order to adapt to the depth of the respective cavity 15 of the building structure under construction.

In particular, every support element 5 comprises two or more blocks 6, optionally identical, mutually stackable, preferably vertically, in order to support the body 3 at a predetermined distance from the bottom surface of the cavity 15 of the building structure under construction. In other words, the number of blocks 6 can vary in order to increase or reduce the distance of the body 3 of the respective disposable formwork 1 from the bottom surface of the cavity 15 of the building structure under construction.

Again, more in detail, each block 6 of every support element 5, on one side, preferably beneath, has an engagement seat 6*a* (FIG. 12), on the other, preferably above, has an engagement projection 6*b* (FIGS. 1, 7, 8 and from 10 to 13). The engagement seat 6*a* and the engagement projection 6*b* are advantageously counter-shaped so as to allow a stable engagement between the stacked blocks 6 that form the respective support element 5.

Each block 6, suitable for forming the support elements 5 of every disposable formwork 1, has a substantially quadrangular shape, preferably squared the transversal width of which allows the respective support element 5 to simultaneously support four disposable formworks 1.

Figure 4:
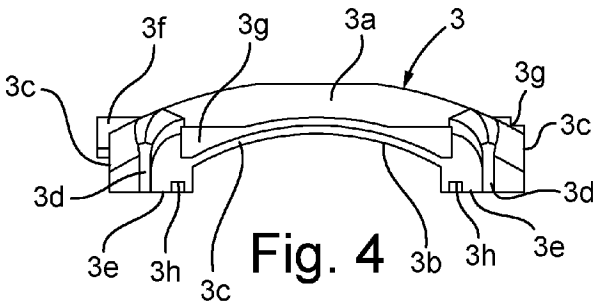
FIG. 4 is a second side view of the disposable formwork according to the previous figures.
Figure 3:
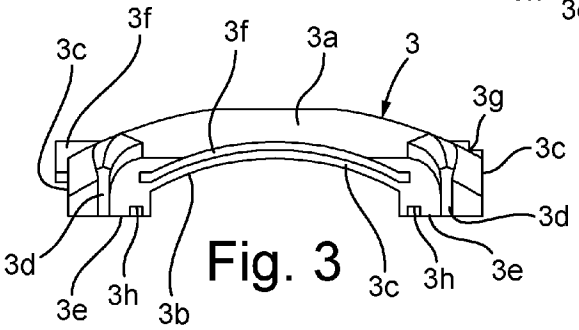
FIG. 3 is a first side view of the disposable formwork according to the previous figures.
Figure 6:
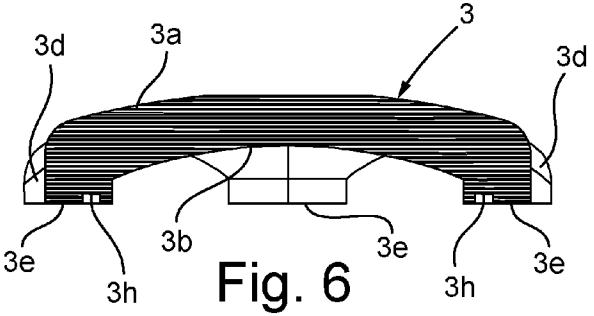
FIG. 6 is a further section of the disposable formwork according to the previous figures carried out along the line VI-VI of FIG. 2.
Figure 2:
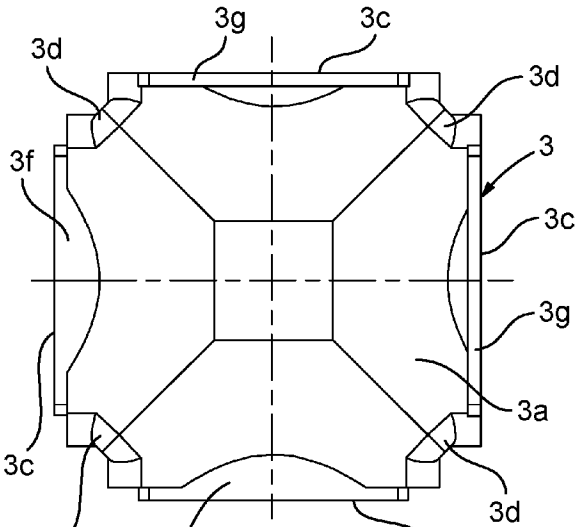
FIG. 2 is a plan view of the disposable formwork according to FIG. 1.
Figure 5:
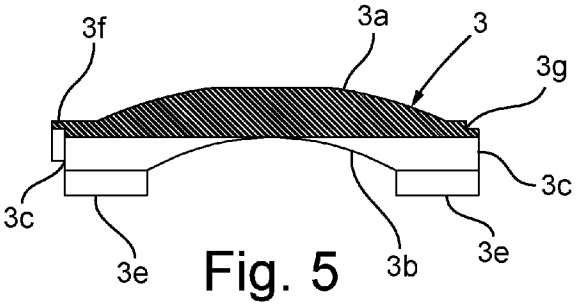
FIG. 5 is a section view of the disposable formwork according to the previous figures made along the line IV-IV of FIG. 2.

More in particular, as visible in the loose stone foundations 2 illustrated in FIGS. 7, 10, 11 and 15, each block 6 defining a respective support element 5 is capable of housing, engaged at the top, the corners 3*d* of the bodies 3 of four disposable formworks 1. In order for the blocks 6 of the support elements 5 to be compatible with the bodies 3 of the formworks 1, the support portions 3*e* of such bodies 3 are provided with corresponding engagement seats 3*h* (FIGS. 1, 3, 4 and from 6 to 10).

Advantageously, each block 6 of every support element 5 also has a through-opening 6*c* inside which the casting of binding material accumulates so as to stably fix the entire structure of the formwork 1. Since each block 6 of every support element 5 is axially open, the corresponding support element 5 is internally hollow so as to be filled in with the casting of binding material.

According to a further advantageous aspect of the present invention, at least one of the lateral dimensions of the disposable formwork 1 is adjustable in order to adapt to the same lateral surface of the cavity 15 of the building structure under construction which faces the formwork itself.

In detail, the adjustment of the side dimensions of each disposable formwork 1 is carried out by means of at least one spacer element 7 (FIGS. 7, 10, 11 and 14) which can be applied laterally to the respective disposable formwork 1 so as to increase the respective side dimension thereof. Advantageously, the lateral adjustment of each disposable formwork 1 can be actuated by applying two or more spacer elements 7, preferably identical to one another, that can be applied laterally to the same. The spacer elements 7 can preferably engage with one another according to aligned configurations, optionally along a substantially rectilinear direction, even more preferably according to an engagement, substantially and optionally in fit-coupling engagement, which provides engagement projections and seats that are suitably counter-shaped.

Figure 11:
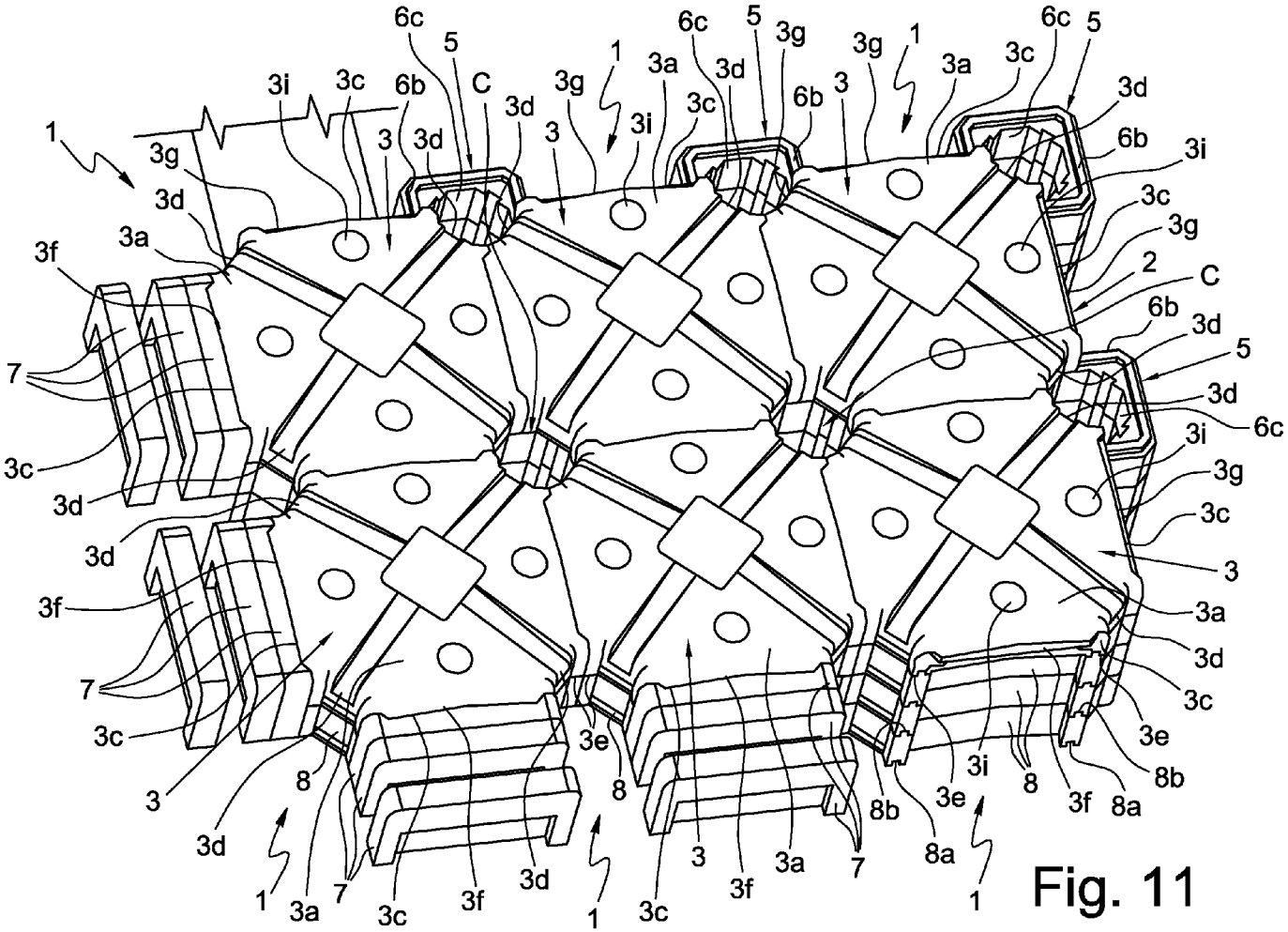
FIG. 11 is an upper perspective view of a second example of ventilated loose stone foundation made of a plurality of disposable formworks according to FIGS. 7 and 8.

With reference to FIGS. 10 to 12, the disposable formworks can be provided with auxiliary support elements 8 having different shapes with respect to the blocks 6 that form the support elements 5. The auxiliary support elements 8 are advantageously provided with corresponding engagements seats 8*a* and with respective engagement projections 8*b* that can be coupled with the engagement projections 6*b* and the engagements seats 6*a* of the aforementioned blocks and with the engagement seats 3*h* of the support portions 3*e* of the bodies 3 of the formworks themselves.

Figure 14:
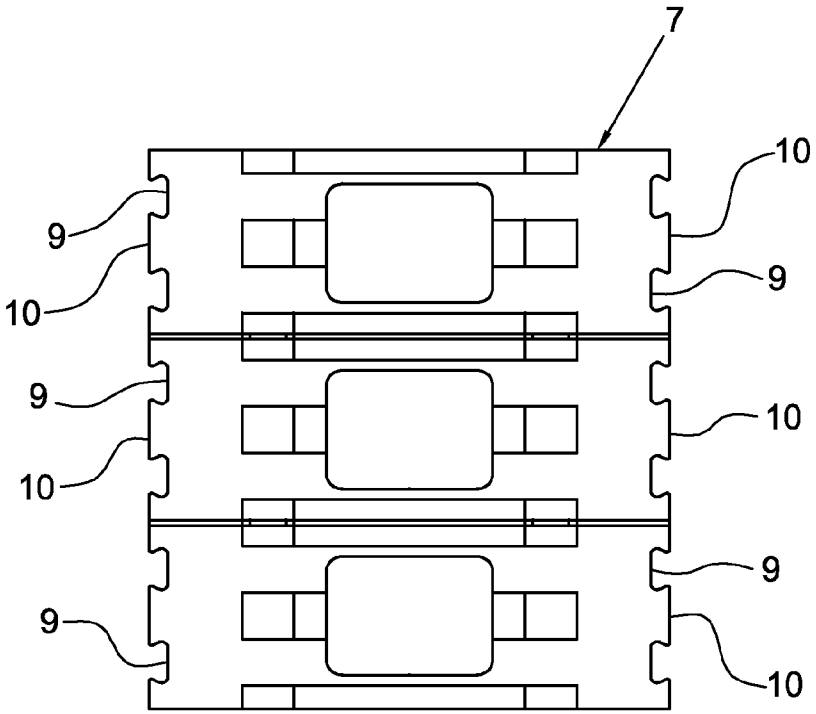
FIG. 14 is a plan view of another component of the formwork according to FIG. 8 and from 10 to 12, in accordance with a further embodiment.
Figure 13:
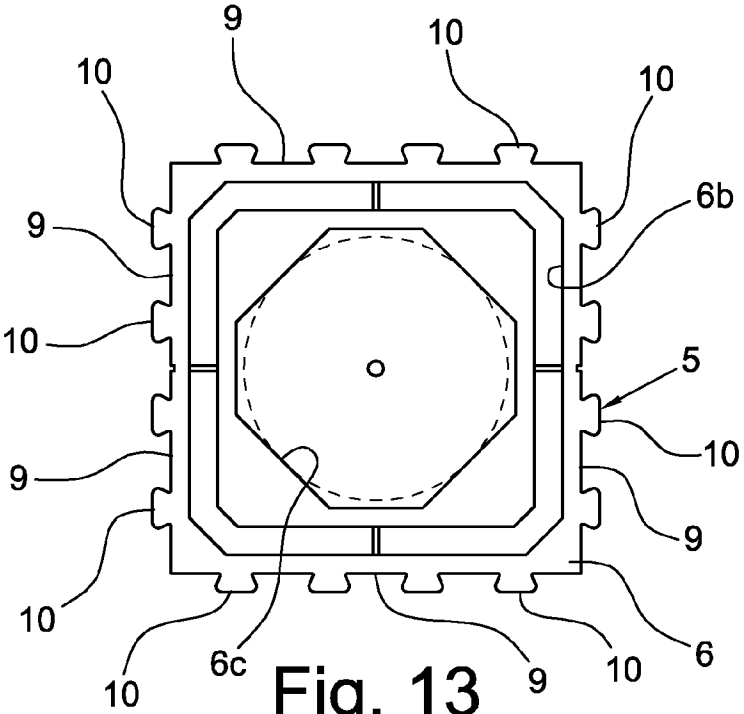
FIG. 13 is a view from above of a component of the formwork according to FIG. 8 and from 10 to 12, in accordance with a further embodiment.
Figure 15:
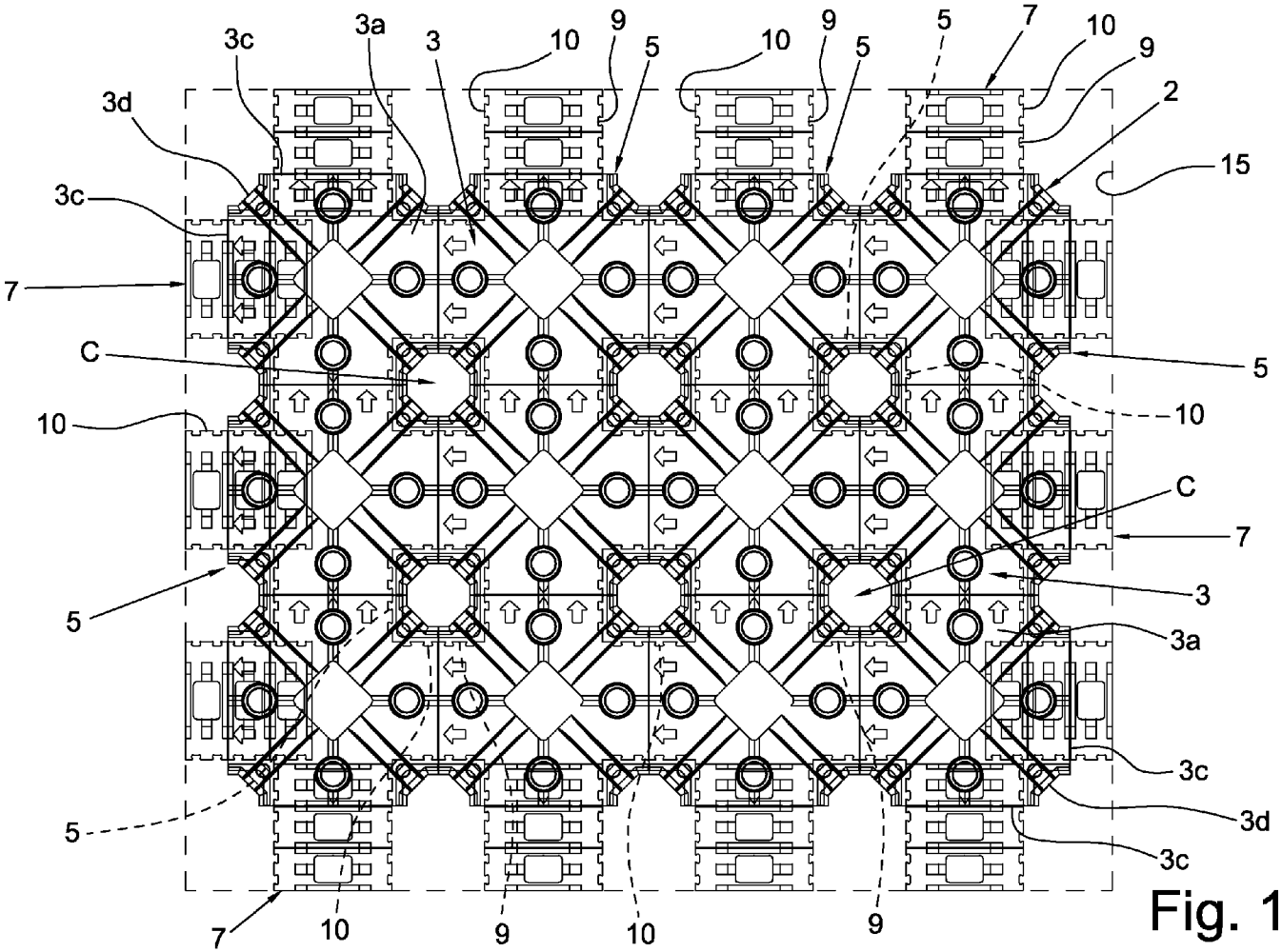
FIG. 15 is a plan view of a ventilated loose stone foundation that is made of a plurality of disposable formworks provided with the components according to FIGS. 13 and 14.

In accordance with the embodiments illustrated in FIGS. 13 to 15, the blocks 6 of each support element and the spacer elements 7 are, at least partly peripherally, each provided with a plurality of seats 9 and protrusions 10, preferably having dovetail-shaped profiles.

In detail, as visible in FIGS. 13 and 15, the blocks 6 have, optionally on each side, a series of seats 9 and protrusions 10 that are dovetail-shaped consecutively interposed.

Similarly to the blocks 6 of the support elements 5, also the spacer elements 7, as visible in FIGS. 14 and 15, have, on the faces facing the support elements 5, a series of seats 9 and protrusions 10 that are dovetail-shaped and consecutively interposed.

Advantageously, the protrusions 10 of the blocks 6 and of the spacer elements 7 are counter-shaped with respect to the seats 9 respectively of the spacer elements 7 and of the blocks 6 so that the latter can engage mutually according to a stable and fixed engagement.

As visible in FIG. 15, the presence of the seats 9 and of the dovetail-shaped protrusions allows making a series of stable connections that give the finished loose stone foundation 2 a compact structure and resistance to strong stress. In order to ensure heat insulation between the cavity 4 defined by the ventilated loose stone foundation 2 and the building structures above, as well as to reduce the masses and overall production and commercialisation costs of the aforementioned disposable formworks 1, the latter are preferably made so as to comprise at least one portion made of expanded or extruded polystyrene.

In detail, the body 3 of every disposable formwork 1 is at least partially, preferably completely, made of polystyrene.

Advantageously, the entire structure of each disposable formwork 1 is made of polystyrene, including the support elements 5 and/or the spacer elements 7 and/or the auxiliary support elements 8.

The disposable formwork 1 for making ventilated loose stone foundations 2 described above solves the problems found in the prior art and obtains important advantages.

Firstly, the disposable formwork is capable of heat insulating the building structures above with respect to the ventilated cavity beneath.

In addition, since such a disposable formwork is completely made of polystyrene, it is particularly light with respect to formworks of polypropylene.

Moreover, the material with which such a formwork is made greatly cuts down the production and commercialisation costs thereof.

It is furthermore worth noting that the modular structure of the support elements and of the spacer elements allows greatly reducing the storage and transportation volumes required, since both the support elements and the spacer elements are made of identical blocks or portions that can be easily and simply stored.

Finally, it should be noted that the particular configuration of the support elements and of the spacer elements permits an easy and practical adjustment of the height and of the width of each disposable formwork that can be used for making ventilated loose stone foundations.

The presence of the dovetail-shaped seats and protrusions permits a stable connection between the blocks of the support elements and of the spacer elements giving the structure of the loose stone foundations made the compactness useful to withstand great loads, as well as great stress.

The invention claimed is:

1. A disposable formwork for making ventilated loose stone foundations, comprising:

a body having a first substantially convex surface configured to receive at least one binding material, and a second surface, facing the opposite side of said first surface, substantially concave and suitable for delimiting, at least partly, a cavity; and at least four support elements, each having at least one contact portion arranged to engage a bottom surface of a cavity of a building structure under construction, said at least four support elements supporting said body, wherein:

said disposable formwork is completely made of polystyrene, said disposable formwork is adjustable in height in order to adapt to the depth of the respective cavity of the building structure under construction, and said at least four support elements each comprise two or more blocks, mutually stackable in order to support said body at a predetermined distance from the surface of said cavity of said building structure under construction, the number of said blocks being variable in order to increase or reduce the distance of said body of said disposable formwork from said surface of said cavity of said building structure under construction, and wherein said blocks are hollow and configured to receive said binding material.

2. The disposable formwork according to claim 1, wherein each block of said support elements has, on one side, an engagement seat, on the other one, an engagement projection, said engagement seat and engagement projection being counter-shaped for permitting a stable engagement between two or more stacked blocks of said support elements.

3. The disposable formwork according to claim 1, wherein at least one of the lateral dimensions of said disposable formwork is adjustable in order to adapt the disposable formwork to a lateral surface of said cavity of said building structure under construction facing said disposable formwork itself.

4. The disposable formwork according to claim 3, comprising at least one spacer element applicable laterally to said disposable formwork for increasing at least one of the lateral dimensions of the disposable formwork.

5. The disposable formwork according to claim 4, wherein each block of every support element and each spacer element is provided with a plurality of seats and protrusions, said seats and protrusions interacting so as to determine the engagement, between said blocks of said support elements and said spacer elements.

6. The disposable formwork according to claim 5, wherein the protrusions of the blocks of each support element and of each spacer element are counter-shaped with respect to the seats respectively of the spacer elements and of the blocks of the support elements so as to ensure a stable and fixed coupling between the latter.

7. The disposable formwork according to claim 5, wherein the plurality of seats and protrusions has a dovetail-shaped profile.

8. The disposable formwork according to claim 7, wherein the plurality of seats and protrusions are consecutively interposed.

9. The disposable formwork according to claim 5, wherein the engagement is a fit-coupling engagement.

10. The disposable formwork according to claim 3, comprising two or more spacer elements, applicable laterally to said disposable formwork for increasing at least one of the lateral dimensions of the disposable formwork, said spacer elements being engageable to each other according to an aligned configuration.

11. A ventilated foundation, comprising a plurality of disposable formworks engaged and/or arranged according to a substantially matrix configuration for lying inside a cavity of a building structure under construction, wherein each of said disposable formworks of said ventilated foundation comprises the disposable formwork according to claim 1.

12. The disposable formwork according to claim 1, wherein the at least one binding material is concrete.

* * * * *